US010204560B2

(12) United States Patent
Yang et al.

(10) Patent No.: US 10,204,560 B2
(45) Date of Patent: Feb. 12, 2019

(54) EMISSION-CONTROL CIRCUIT, DISPLAY APPARATUS HAVING THE SAME, AND DRIVING METHOD THEREOF

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shengji Yang, Beijing (CN); Xue Dong, Beijing (CN); Hailin Xue, Beijing (CN); Xiaochuan Chen, Beijing (CN); Xiaoliang Ding, Beijing (CN); Yingming Liu, Beijing (CN); Haisheng Wang, Beijing (CN); Rui Xu, Beijing (CN); Lei Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 28 days.

(21) Appl. No.: 15/543,561

(22) PCT Filed: Jul. 20, 2016

(86) PCT No.: PCT/CN2016/090670
§ 371 (c)(1),
(2) Date: Jul. 13, 2017

(87) PCT Pub. No.: WO2018/014251
PCT Pub. Date: Jan. 25, 2018

(65) Prior Publication Data
US 2018/0330663 A1 Nov. 15, 2018

(51) Int. Cl.
*G09G 3/3258* (2016.01)

(52) U.S. Cl.
CPC ..... *G09G 3/3258* (2013.01); *G09G 2310/08* (2013.01); *G09G 2320/043* (2013.01); *G09G 2320/064* (2013.01); *G09G 2360/145* (2013.01)

(58) Field of Classification Search
CPC ..... G09G 3/3258; G09G 2320/043; G09G 2320/048; G09G 2360/14–2360/142; G09G 2360/145–2360/148
(Continued)

(56) References Cited

U.S. PATENT DOCUMENTS

2016/0240127 A1 8/2016 Duan et al.
2016/0307500 A1 10/2016 Han
(Continued)

FOREIGN PATENT DOCUMENTS

CN 103280183 A 9/2013
CN 104575386 A 4/2015
(Continued)

OTHER PUBLICATIONS

International Search Report & Written Opinion dated Apr. 28, 2017 regarding PCT/CN2016/090670.
(Continued)

*Primary Examiner* — Michael Pervan
(74) *Attorney, Agent, or Firm* — Intellectual Valley Law, P.C.

(57) ABSTRACT

The present application discloses an emission-control circuit for controlling light emission of an organic light emitting diode (OLED), including a light sensor configured to detect an intensity of emitted light of the OLED; a first thin-film
(Continued)

transistor (TFT); a second TFT; a third TFT; a fourth TFT; a fifth TFT; a sixth TFT; a first capacitor, and a second capacitor.

20 Claims, 9 Drawing Sheets

(58) Field of Classification Search
USPC ..... 345/207
See application file for complete search history.

(56) References Cited

U.S. PATENT DOCUMENTS

| | | | |
|---|---|---|---|
| 2016/0307501 | A1 | 10/2016 | Han |
| 2017/0162118 | A1 | 6/2017 | Liu et al. |

FOREIGN PATENT DOCUMENTS

| | | | |
|---|---|---|---|
| CN | 104575387 | A | 4/2015 |
| CN | 104916255 | A | 9/2015 |
| CN | 105679242 | A | 6/2016 |

OTHER PUBLICATIONS

The First Office Action in the Chinese Patent Application No. 201680000604.3, dated Jun. 27, 2017; English translation attached.

FIG. 1
*Related Art*
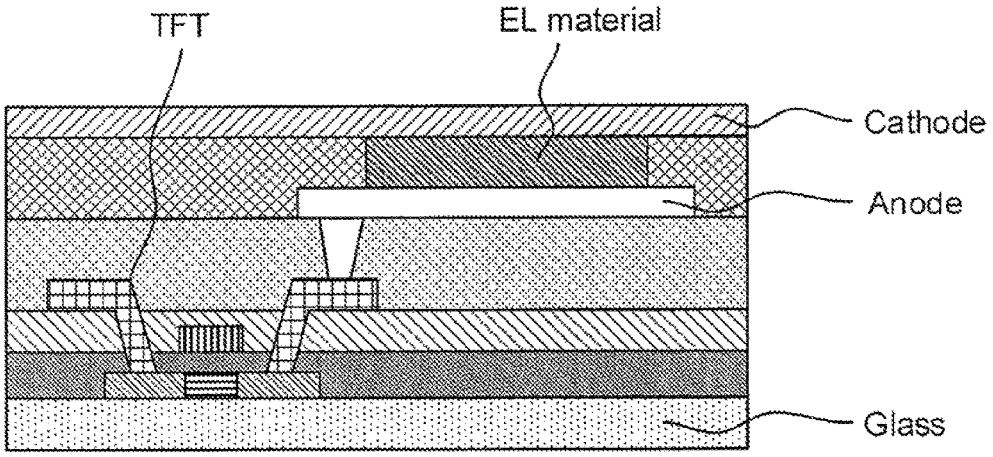
FIG. 2
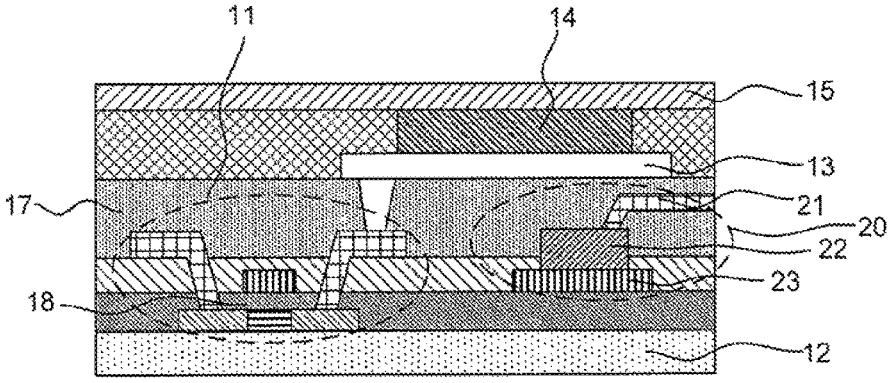
Fig. 2

EMISSION-CONTROL CIRCUIT, DISPLAY APPARATUS HAVING THE SAME, AND DRIVING METHOD THEREOF

CROSS-REFERENCE TO RELATED APPLICATION

This application is a national stage application under 35 U.S.C. § 371 of International Application No. PCT/CN2016/090670 filed Jul. 20, 2016, the contents of which are incorporated by reference in the entirety.

TECHNICAL FIELD

The present invention relates to a field of display technology, particularly, to an emission-control circuit, a display apparatus having the same, and a driving method thereof.

BACKGROUND

Organic Light Emitting Diode (OLED) display has been a focus of research in display technology. As compared to liquid-crystal display (LCD) apparatuses, OLED display apparatuses have many advantages such as low power consumption, low fabrication cost, self-illumination, a wider viewing angle and faster response. As such, OLED displays have found a wide range of applications such as in mobile phones, personal digital assistance (PDAs), digital cameras, televisions, tablet computers, and laptop computers.

SUMMARY

In one aspect, the present invention provides an emission-control circuit for controlling light emission of an organic light emitting diode (OLED), comprising a light sensor configured to detect an intensity of emitted light of the OLED; a first thin-film transistor (TFT); a second TFT; a third TFT; a fourth TFT; a fifth TFT; a sixth TFT; a first capacitor; and a second capacitor; wherein the first capacitor has a first terminal configured to be provided with a voltage level Vcom and a second terminal coupled to a first common node shared with a cathode of the light sensor and source nodes of the first TFT and the second TFT; the first TFT has a gate controlled by a first control signal and a drain node configured to be provided with the voltage level Vcom; the second TFT has a gate controlled by a second control signal and a drain node coupled to gates of the third TFT and the fourth TFT; the third TFT has a source node configured to be provided with a system high voltage level $V_{GH}$, and a drain node coupled to a second common node shared with a drain node of the fifth TFT and a first terminal of the second capacitor; the fourth TFT has a source node configured to be provided with the system high voltage level $V_{GH}$; the second capacitor has a second terminal configured to be provided with a third control signal; the fifth TFT has a gate controlled by a fourth control signal and a source node configured to be provided with a system low voltage level $V_{GL}$; and the sixth TFT has a gate coupled to the second common node, a source node configured to be provided with a fifth control signal, and a drain node coupled to a drain node of the fourth TFT for outputting an emission control signal.

Optionally, the light sensor comprises a PN junction on a base substrate of the OLED.

Optionally, the PN junction is a PIN photodiode and configured to have an anode of a P+ doping semiconductor region at a system low voltage level, a cathode of a N+ doping semiconductor region coupled to the first common node, and an intrinsic region of amorphous silicon between the P+ doping semiconductor region and the N+ doping semiconductor region.

Optionally, the PIN photodiode is configured to detect the intensity of emitted light of the OLED for a period of time for generating a photo-current such that a voltage level at the first common node is reduced from the voltage level Vcom by a first amount to a reduced voltage level, the first amount being dependent on doping properties of the P+ doping semiconductor region and the N+ doping semiconductor region.

Optionally, the voltage level at the first common node is reduced to a level sufficiently low for turning on the fourth TFT, provided that the second TFT is turned on by the second control signal.

Optionally, the emission control signal is an input signal for a pixel driving circuit configured to compensate transistor threshold voltage shift of the OLED.

Optionally, the emission control signal is a high voltage level sufficient for turning off the OLED light emission in one or more intermittent time periods in a continuous time span during which the fifth control signal is kept at a low voltage level; and the emission control signal is the high voltage level sufficient for turning off the OLED light emission in a time period during which the fifth control signal is kept at a high voltage level.

Optionally, the third control signal, the fourth control signal, and the fifth control signal are clock signals shared with the pixel driving circuit.

Optionally, the first control signal is an independently generated clock signal for resetting the light sensor.

Optionally, the second control signal is an independent generated clock signal for switching on or off the second TFT.

Optionally, the first TFT, the second TFT, the third TFT, the fourth TFT, the fifth TFT, and the sixth TFT are all P-type transistors.

In another aspect, the present invention provides a driving method for controlling light emission of an organic light emitting diode (OLED) using the emission-control circuit described herein, the driving method comprising, in a first time period, setting the first control signal at a low level sufficient for turning the first TFT on and keeping the first common node at the voltage level Vcom, setting the fourth control signal at a low level sufficient for turning the fifth TFT on to allow the system low voltage level $V_{GL}$ passing to the second common node for turning the sixth TFT on, and setting the second control signal at a high level sufficient for turning the second TFT off and, in turn, turning the third TFT and the fourth TFT off; in a second time period, switching the first control signal to a high level sufficient for turning the first TFT off, setting the second control signal at a low level sufficient for turning the second TFT on, the light sensor is subject to a sufficiently high intensity of emitted light of the OLED to generate a photocurrent to pull down a voltage of the first common node from the voltage level Vcom to a sufficient low voltage level for turning the third TFT on to allow the system high voltage level $V_{GH}$ passing to the second common node for turning the sixth TFT off, setting the fourth control signal at a high level sufficient for turning the fifth TFT off; and turning the fourth TFT on by the sufficiently low voltage level at the first common node to allow the system high voltage level $V_{GH}$ passing to the drain node of the fourth TFT; in a third time period, switching the second control signal to a high level for turning the second TFT off and, in turn, turning the third TFT and the fourth TFT off, setting the fourth control signal at a low level sufficient for turning the fifth TFT on and, in turn, reducing a voltage level at the second common node to a low voltage level sufficient for turning the sixth TFT on; in a fourth time period, keeping the first TFT, the second TFT, the third TFT, the fourth TFT off, switching the fourth control signal to a high level sufficient for turning the fifth TFT off to keep the second common node in a floating state, switching the third control signal to a low level to pull down a voltage of the second common node to a sufficiently low level to keep the sixth TFT on; in a fifth time period, keeping the first TFT, the second TFT, the third TFT, the fourth TFT off, switching the fourth control signal to a low level sufficient for turning the fifth TFT on to pull down a voltage of the second common node to the system low voltage level for turning the sixth TFT on; and in a sixth time period, turning the first TFT and the second TFT on to keep the first common node at the voltage level Vcom to keep the third TFT and the fourth TFT off, switching the fourth control signal to a high level sufficient for turning the fifth TFT off to keep the second common node in a floating state, and setting the third control signal to a low level to pull down a voltage of the second common node to a sufficiently low level to keep the sixth TFT on.

Optionally, in the second time period the sixth TFT is turned off, and the fourth TFT is turned on to pass the system high voltage level $V_{GH}$ from its source node to its drain node for outputting the emission control signal with a high voltage level for intermittently switching OLED light emission off within the second time period.

Optionally, in the third time period and the fourth time period, the fourth TFT is turned off and the sixth TFT is turned on so that the fifth control signal set at a low voltage level is passed from the source node of the sixth TFT to the drain node of the sixth TFT for outputting a low voltage level as the emission control signal to keep the OLED light emission on.

Optionally, in the fifth time period, the fourth TFT is turned off and the sixth TFT is turned on so that the fifth control signal set at a high voltage level is passed from the source node of the sixth TFT to the drain node of the six TFT for outputting a high voltage level as the emission control signal to turn the OLED light emission off.

Optionally, in the first time period, the first control signal is a reset signal selectively applied to the gate of the first TFT.

Optionally, in the sixth time period, the first control signal is a reset signal selectively applied to the gate of the first TFT at a low level sufficient for turning the first TFT on, and the second control signal is set at a low voltage level sufficient for turning the second TFT on.

In another aspect, the present invention provides a display apparatus comprising a plurality of pixels for image display, each pixel comprising at least one organic light emitting diode (OLED); wherein the at least one OLED comprises a base substrate, a thin film transistor on the base substrate, a first electrode layer on a side of the thin film transistor distal to the base substrate, an electroluminescence material layer on a side of the first electrode layer distal to the base substrate, and a second electrode layer on a side of the electroluminescence material layer distal to the first electrode layer; and the emission-control circuit described above configured to generate an emission control signal for selectively turning off the OLED in one or more intermittent time periods during image display based on the intensity of emitted light of the OLED detected by the light sensor.

Optionally, the display apparatus further comprises a pixel driving circuit configured to compensate transistor threshold voltage shift of the OLED, wherein the emission-control circuit is coupled with the pixel driving circuit.

Optionally, the pixel driving circuit comprises a P-type transistor with a gate node controlled by the emission control signal and a drain node connected with the OLED.

BRIEF DESCRIPTION OF THE FIGURES

The following drawings are merely examples for illustrative purposes according to various disclosed embodiments and are not intended to limit the scope of the present invention.

FIG. 1 is a schematic cross-sectional view of a conventional OLED structure.

FIG. 2 is a schematic cross-sectional view of an OLED structure in some embodiments.

DETAILED DESCRIPTION

Figure 3:
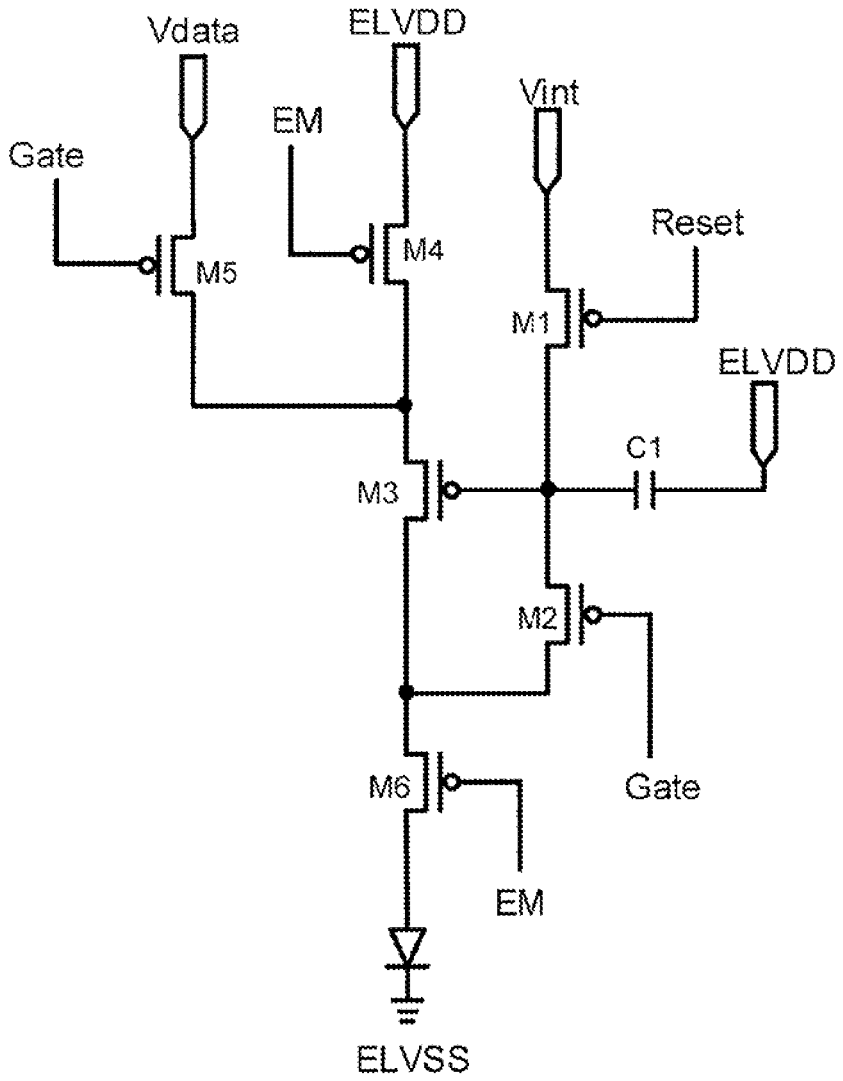
FIG. 3 shows a pixel driving circuit used for compensating a transistor threshold voltage shift on OLED emitting current in some embodiments.

The disclosure will now describe more specifically with reference to the following embodiments. It is to be noted that the following descriptions of some embodiments are presented herein for purpose of illustration and description only. It is not intended to be exhaustive or to be limited to the precise form disclosed.

FIG. 1 is a schematic cross-sectional view of a conventional OLED structure. Referring to FIG. 1, in conventional OLED, each pixel includes a plurality of OLEDs, each of which includes a base substrate, a thin film transistor on the base substrate, an anode layer coupled to the TFT and on a side of the TFT distal to the base substrate, an electroluminescence layer (EL) on a side of the anode layer distal to the TFT, and a cathode layer on a side of the electroluminescence layer distal to the anode layer. The OLED includes one or more functional driving circuits coupled with gate-on-array control peripheral circuits for driving an operation of the OLED, i.e., controlling the on/off state of the OLED for displaying image. The electroluminescence layer includes an organic light emitting material deposited by vapor deposition for emitting a light of color, e.g., Red, Green, Blue, or White light. Different organic light emitting materials may have different light emission life spans. When the OLED emits light at high intensity for an extended period of time, the OLED turns hot with a high temperature, resulting in a reduction of its life span.

The present disclosure provides an improved OLED capable of controlling light emission of the OLED. In some embodiments, the OLED includes an emission-control circuit configured to generate an emission control signal for selectively turning off the OLED in one or more intermittent time periods during image display based on the intensity of emitted light of the OLED detected by a light sensor. For example, when the OLED emits light at high intensity for an extended period of time, the emission-control circuit may generate an emission control signal to turn off the OLED temporarily for an intermittent time period. By having this controlling mechanism, overheating of the OLED may be avoided and the OLED life span may be extended.

In some embodiments, the present emission-control circuit for controlling light emission of an OLED includes a light sensor configured to detect an intensity of emitted light of the OLED; a first TFT, a second ITT; a third TFT; a fourth TFT; a fifth TFT; a sixth TFT; a first capacitor; and a second capacitor. In some embodiments, the present emission-control circuit is coupled to a pixel driving circuit in association with gate-on-array (GOA) peripheral circuit, the pixel driving circuit being configured to compensate transistor threshold voltage shift of the OLED, i.e., a pixel compensation circuit. Optionally, the emission control signal is an input signal for the pixel driving circuit.

FIG. 2 is a schematic cross-sectional view of an OLED structure in some embodiments. Referring to FIG. 2, the present OLED includes a TFT 11 on a base substrate 12, a first electrode layer 13 on a side of the TFT 11 distal to the base substrate 12, an electroluminescence material layer 14 on a side of the first electrode layer 13 distal to the TFT 11, and a second electrode layer 15 on a side of the electroluminescence material layer 14 distal to the first electrode layer 13. Optionally, the first electrode layer 13 is an anode layer and the second electrode layer 15 is a cathode layer. As shown in FIG. 2, the present OLED further includes a light sensor 20 configured to detect an intensity of emitted light of the OLED. The light sensor 20 may be fabricated during a back panel process for forming driving thin-film transistors on the base substrate 12.

In some embodiments, the light sensor 20 may be a PN junction device. For example, the PN junction device may be in close proximity to the anode layer 13 of the OLED to sense light emitted from the OLED during image display. Optionally, the PN junction device is on a side of a passivation layer 17 distal to the anode layer 13, a projection of the PN junction device overlaps with a projection of the anode layer on the base substrate 12. Optionally, the driving TFT is a top-gate type driving TFT, and the PN junction device 20 is on a side of the gate insulating layer 18 distal to the base substrate 12.

In some embodiments, the OLED further includes other components of the emission-control circuit such as a plurality of TFTs (e.g., the first to the sixth TFT) and multiple capacitors, coupled to the light sensor 20 (e.g., the PN junction device). In some embodiments, the OLED further includes a pixel driving circuit configured to compensate transistor threshold voltage shift of the OLED (e.g., a pixel compensation circuit) coupled to the emission-control circuit.

In some embodiments, the PN junction device is a thin-film PIN junction photodiode having a structure of a P+ doping semiconductor layer 21 as an anode overlying an amorphous Silicon (a+Si doping) intrinsic layer 22 on an N+ doping semiconductor layer 23 as a cathode. The PIN junction photodiode is reverse biased such that the anode is coupled to a low potential level and the cathode is coupled to a high potential level. In an example, the N+ doping semiconductor layer 23 is biased positive and the P+ doping semiconductor layer 21 is biased more negative.

Despite excellent device performance of TFT-driven OLED image display, the instability of the threshold voltage of driving transistor under gate voltage and light illumination stress is a major issue that requires a pixel compensation circuit to be implemented with each typical 2-transistor pixel circuit to compensate for the threshold voltage shifts to ensure stability and uniformity of OLED emitted light for image display. Examples of pixel compensation circuit include, but are not limited to, a 6T1C circuit, a 2T1C circuit, a 4T1C circuit, and a T1C circuit. FIG. 3 shows a pixel driving circuit (e.g., 6T1C) used for compensating driving transistor threshold voltage Vt shift effect on OLED emitting current. As an example, it has one storage capacitor C1 and 6 transistors coupled to the OLED light emitting unit. The 6 transistors are all P-type TFTs including 5 switch transistors M1, M2, M4, M5, M6 and one driving transistor M3. The first switch TFT M1 has a gate controlled by a Reset control signal and a source coupled to a fixed Vint voltage. The first switch TFT M1 has a drain connected to a first terminal of the storage capacitor C1. The storage capacitor C1 has its second terminal coupled to a system high voltage level ELVDD. The first terminal of the storage capacitor C1 is connected to a gate of the driving TFT M3 and a source of the second switch TFT M2. The second TFT M2 has a gate controlled by Gate control signal and a drain connected to a drain of the driving TFT M3. The fifth TFT M5 has a gate controlled by the same Gate control signal and a source coupled to Vdata signal and a drain connected to a source of the driving TFT M3. The driving TFT M3 is disposed in series between the fourth TFT M4 and the sixth TFT M6. The fourth TFT M4 has a source coupled to the system high voltage level ELVDD and a drain connected to the source of the driving TFT M3. The sixth TFT M6 has a source connected to the drain of the driving TFT M3 and a drain connected to the anode of the OLED which has its cathode connected to a system low voltage level ELVSS (e.g., −7V). Both the fourth TFT M4 and the sixth TFT M6 may be turned on or off by a gate control signal EM. When the sixth TFT M6 is turned on, a current flowing through the driving TFT M3 and the sixth TFT M6 may be used as a control current for triggering the OLED emission.

In this example, the OLED has its cathode connected to the system low voltage level ELVSS while the source of M4 is coupled to the system high voltage level ELVDD. In order to drive the OLED, several key control signals of Reset, Gate, and EM are employed in the pixel driving circuit in a sequential timing waveforms.

Figure 4:
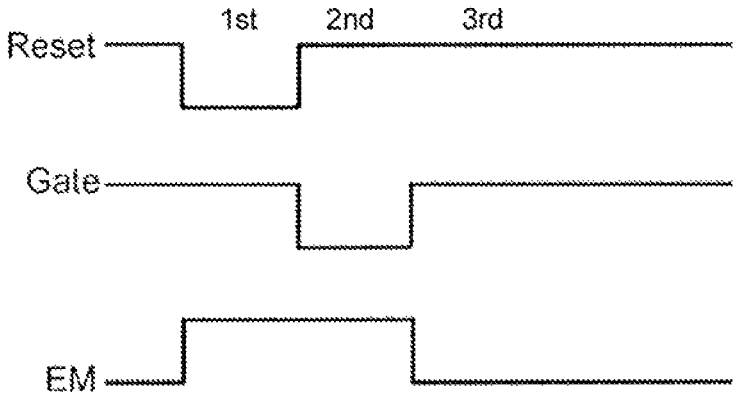
FIG. 4 is a timing waveform for operating the pixel driving circuit of FIG. 3.

FIG. 4 is a timing waveform for operating the pixel driving circuit of FIG. 3 to ensure that $V_{GS}$ of the driving TFT M3 will not be affected by the threshold voltage Vt, and to keep the OLED driving current stable. As shown, in a first phase, the Reset signal is set to a low level and the Gate control signal is at a high level. As a result, the first TFT M1 is turned on but the second TFT M2 is turned off. Therefore, the first terminal of the storage capacitor C1 is reset to Vint voltage level while its second terminal is connected to system high voltage level ELVDD. In this phase, the EM signal is high so that both the fourth TFT M4 and the sixth TFT M6 are turned off, and no current is conducted to the OLED.

In a second phase, the Reset signal is switched to high to turn off M but the Gate signal is switched to low to turn on M2 to short the gate and drain of the driving TFT M3 which functions as a diode entering into a saturation state. At the same time, Vdata is passed to the source of the driving TFT M3 by turning on the fifth TFT M5 by the low Gate signal. Now, a gate-source voltage $V_{GS}$ of the driving TFT M3 is just the threshold voltage Vt. Therefore, the voltage level at the gate of M3, which is also the first terminal of C1, changes from Vint to Vdata+Vt. Thus, the voltage across the capacitor C1 becomes $V_{C1}$=ELVDD−Vdata−Vt. At this phase, the EM signal remains high so that both the fourth TFT M4 and the sixth TFT M6 are turned off, and no current is conducted to the OLED.

In a third phase, the Gate signal is switched again to high to turn off both M2 and M5. The EM signal now is switched to low so that both M4 and M6 are turned on. Thus, the source of the driving TFT M3 now is changed to ELVDD passed from the TFT M4. But the gate of the TFT M3 remains at Vdata+Vt so that a drain current of M3 will be proportional to $(V_{GS}-Vt)^2=(Vdata+Vt-ELVDD-Vt)^2=(Vdata-ELVDD)^2$, which is independent of Vt. Therefore, the pixel driving circuit is able to provide a full Vt compensation while driving the OLED light emission.

Figure 5A:
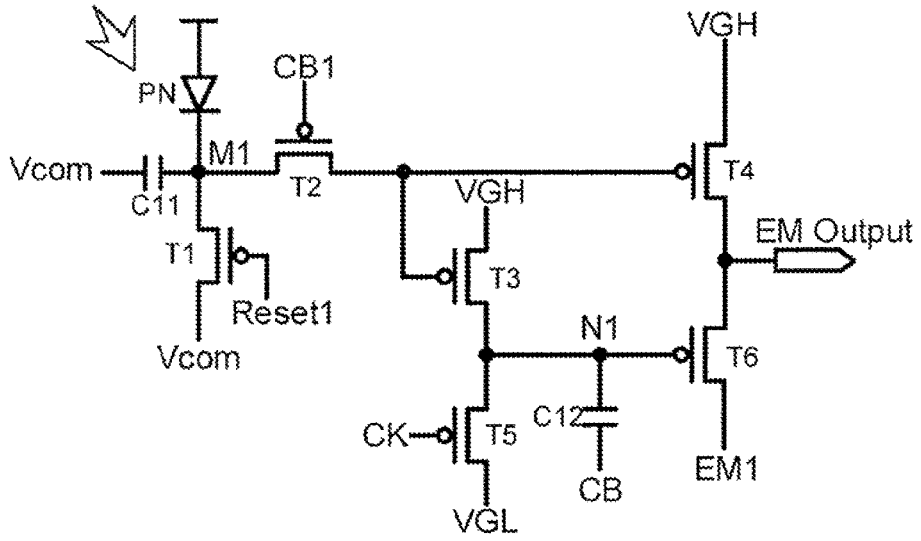
FIG. 5A shows an emission-control circuit in some embodiments.
Figure 5B:
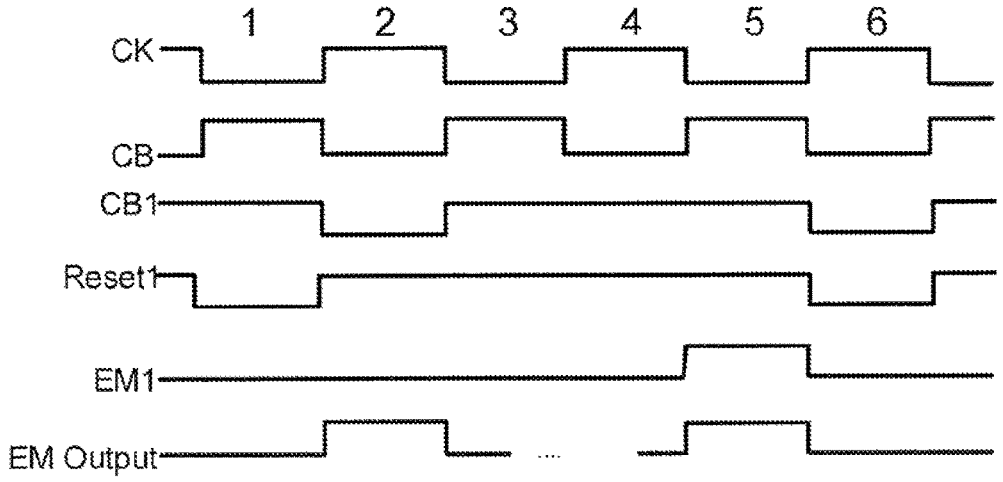
FIG. 5B shows an operational timing waveform for operating the emission-control circuit of FIG. 5A.
Figure 6A:
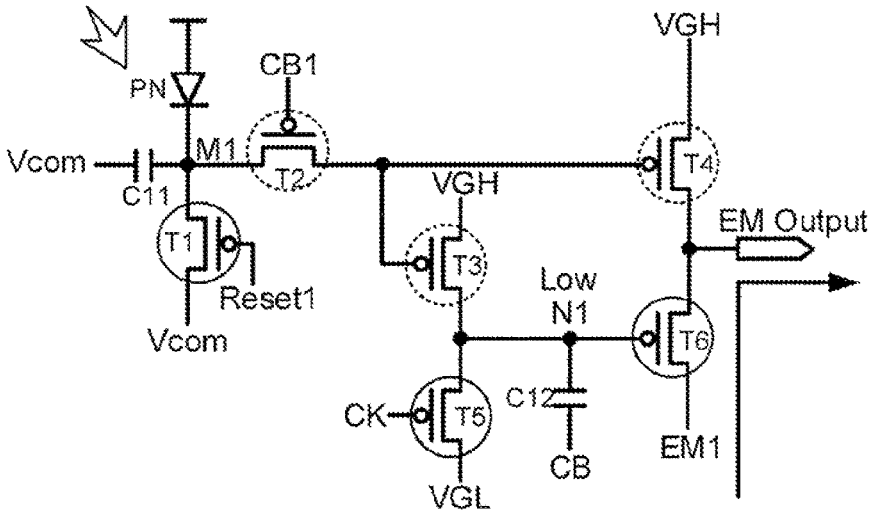
FIG. 6A is the emission-control circuit operated at a first time period set in the operational timing waveform in some embodiments.
Figure 6A:
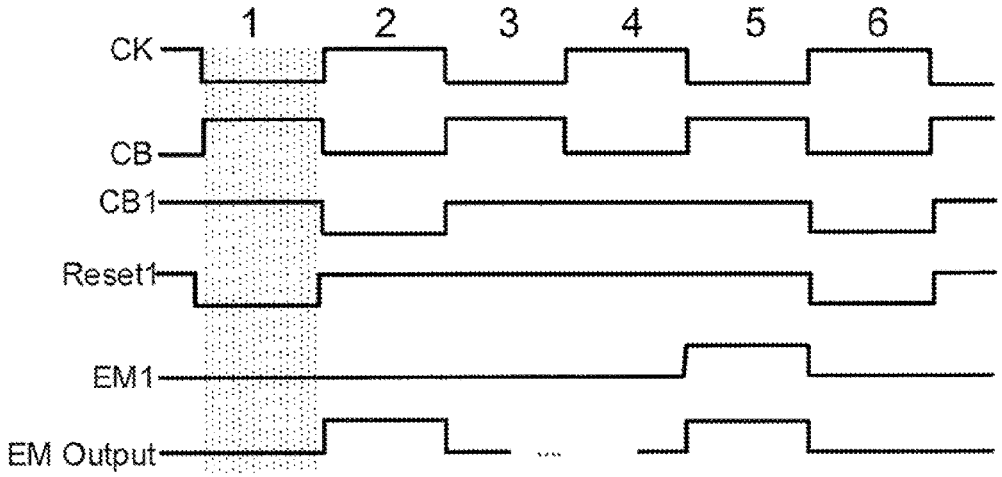
Figure 6B:
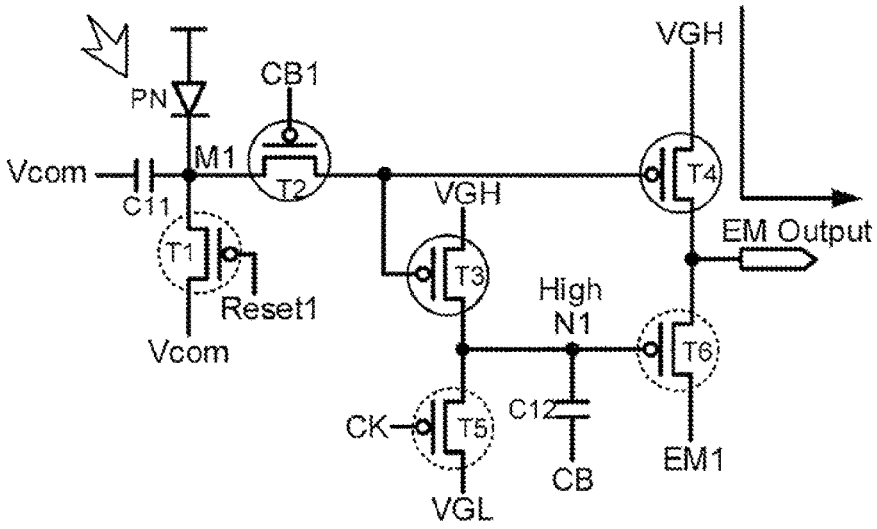
FIG. 6B is the emission-control circuit operated at a second time period set in the operational timing waveform in some embodiments.
Figure 6B:
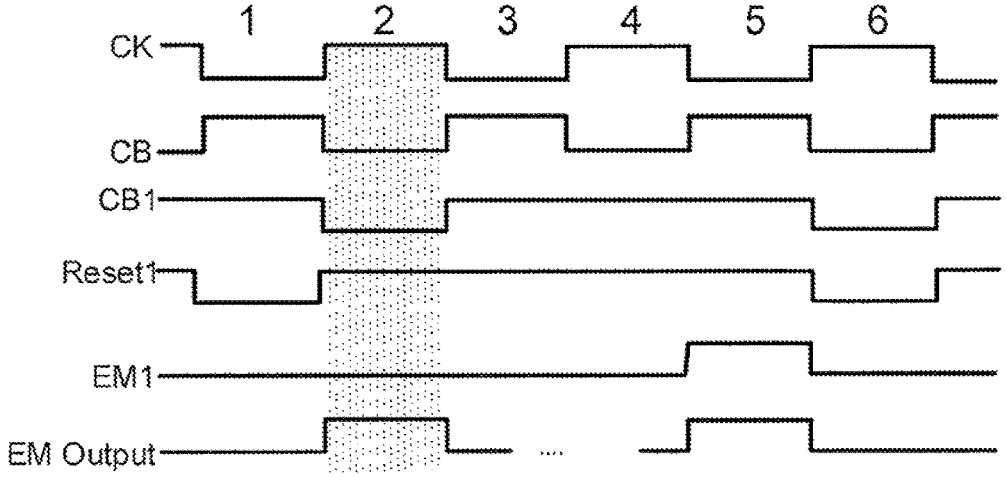
Figure 6C:
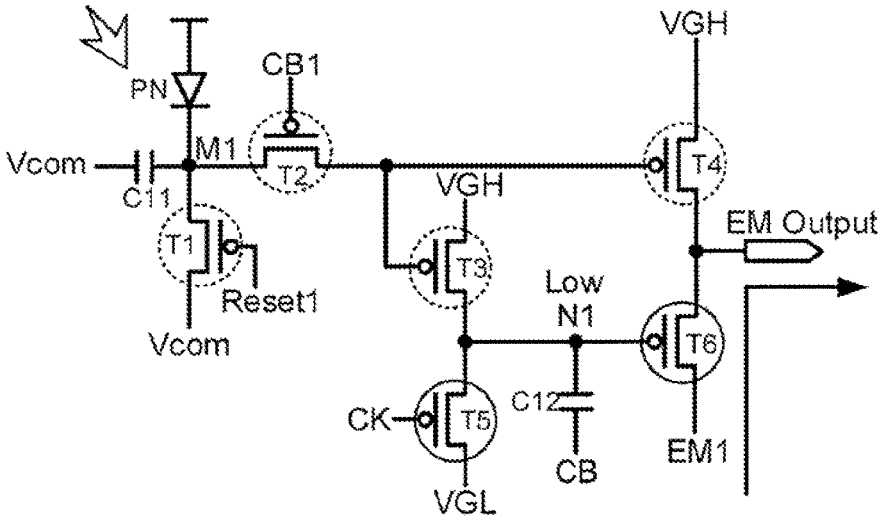
FIG. 6C is the emission-control circuit operated at a third time period set in the operational timing waveform in some embodiments.
Figure 6C:
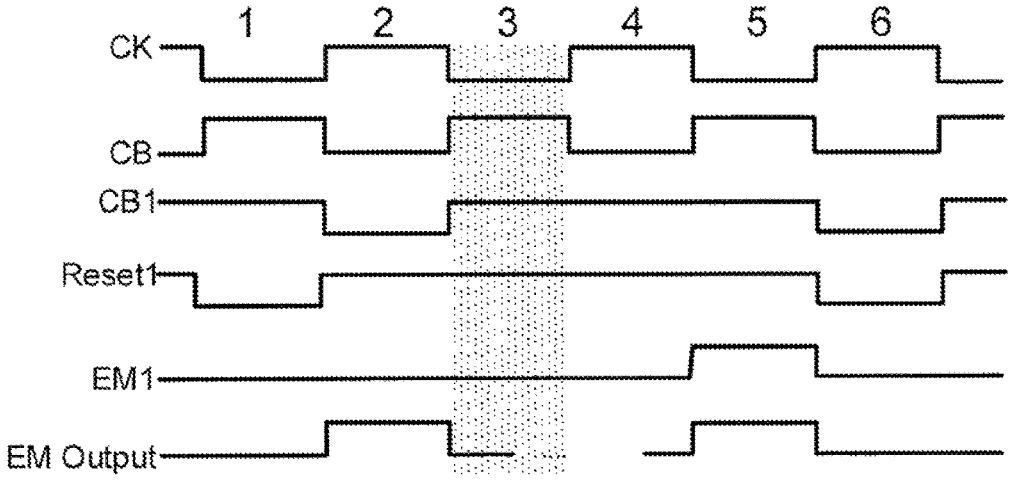
Figure 6D:
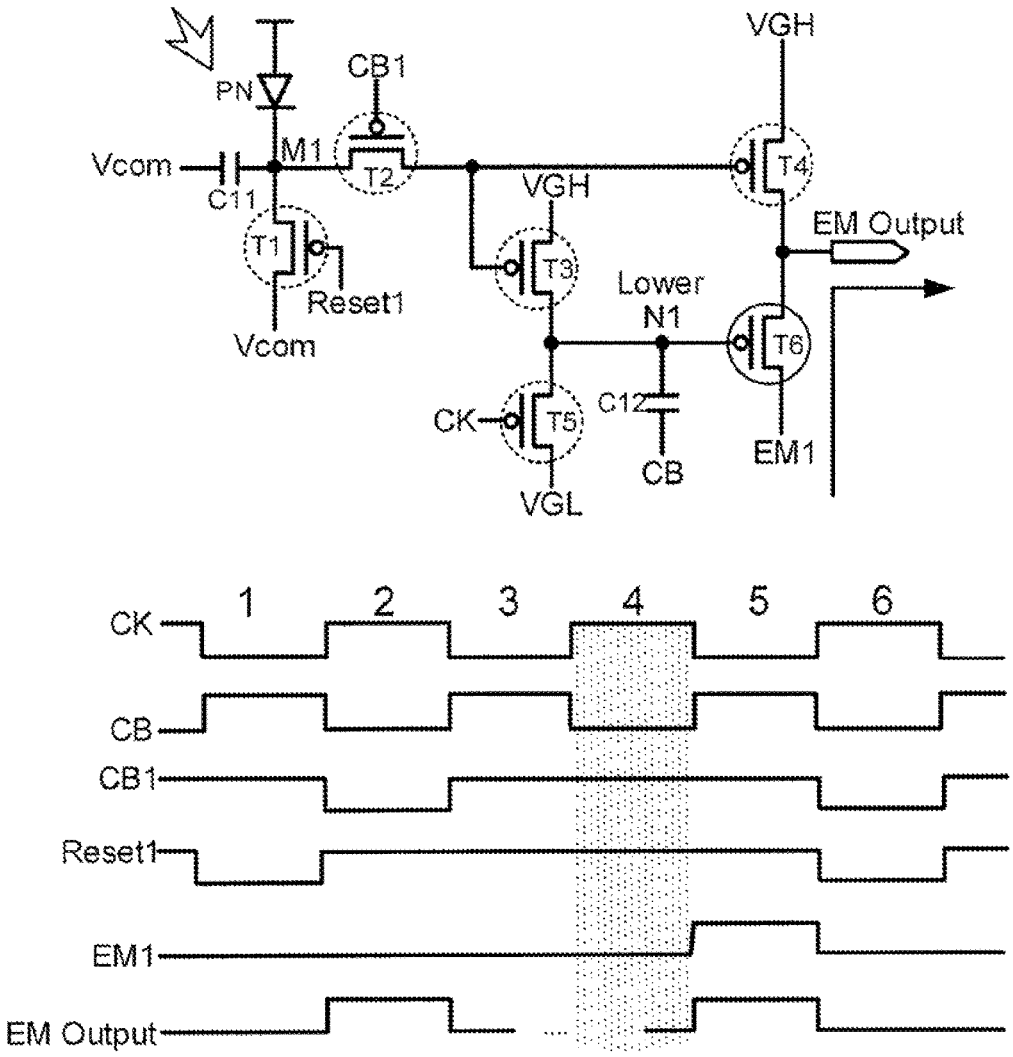
FIG. 6D is the emission-control circuit operated at a fourth time period set in the operational timing waveform in some embodiments.
Figure 6E:
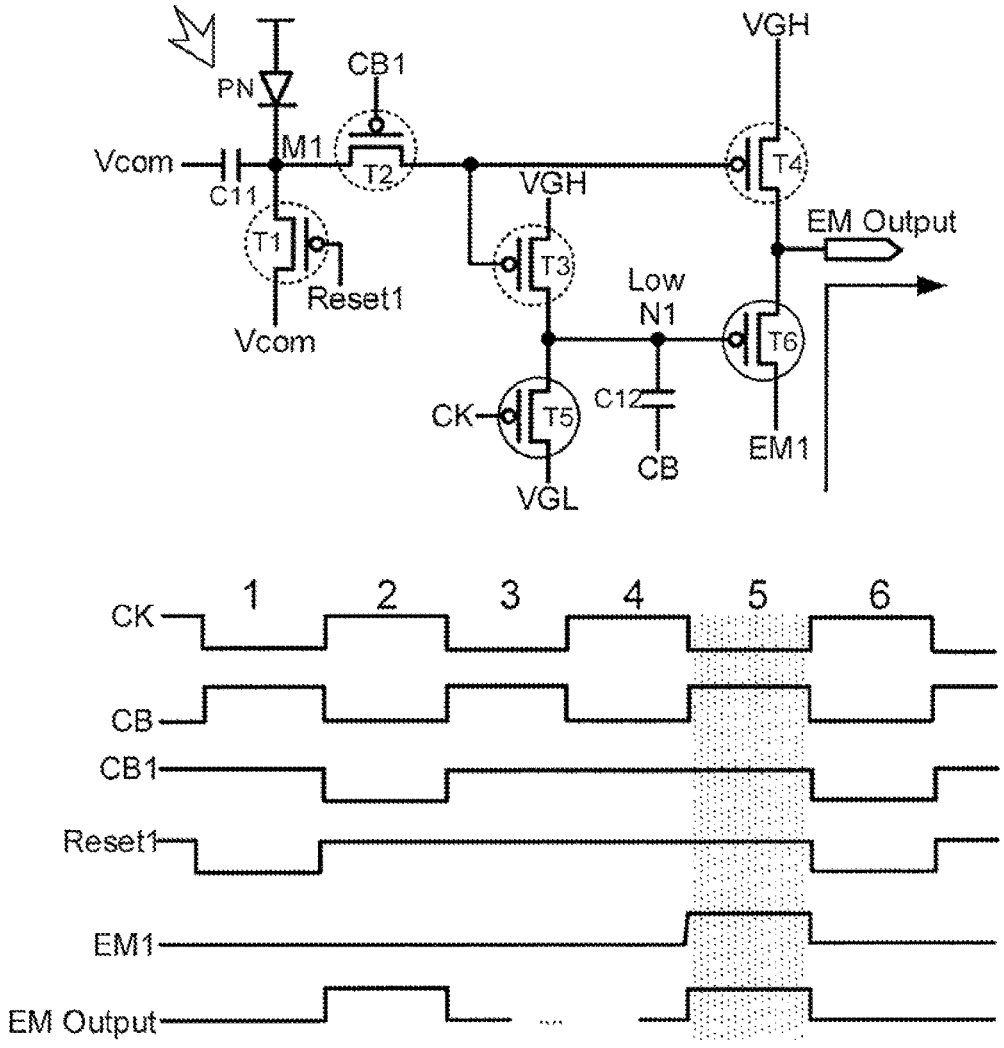
FIG. 6E is the emission-control circuit operated at a fifth time period set in the operational timing waveform in some embodiments.
Figure 6F:
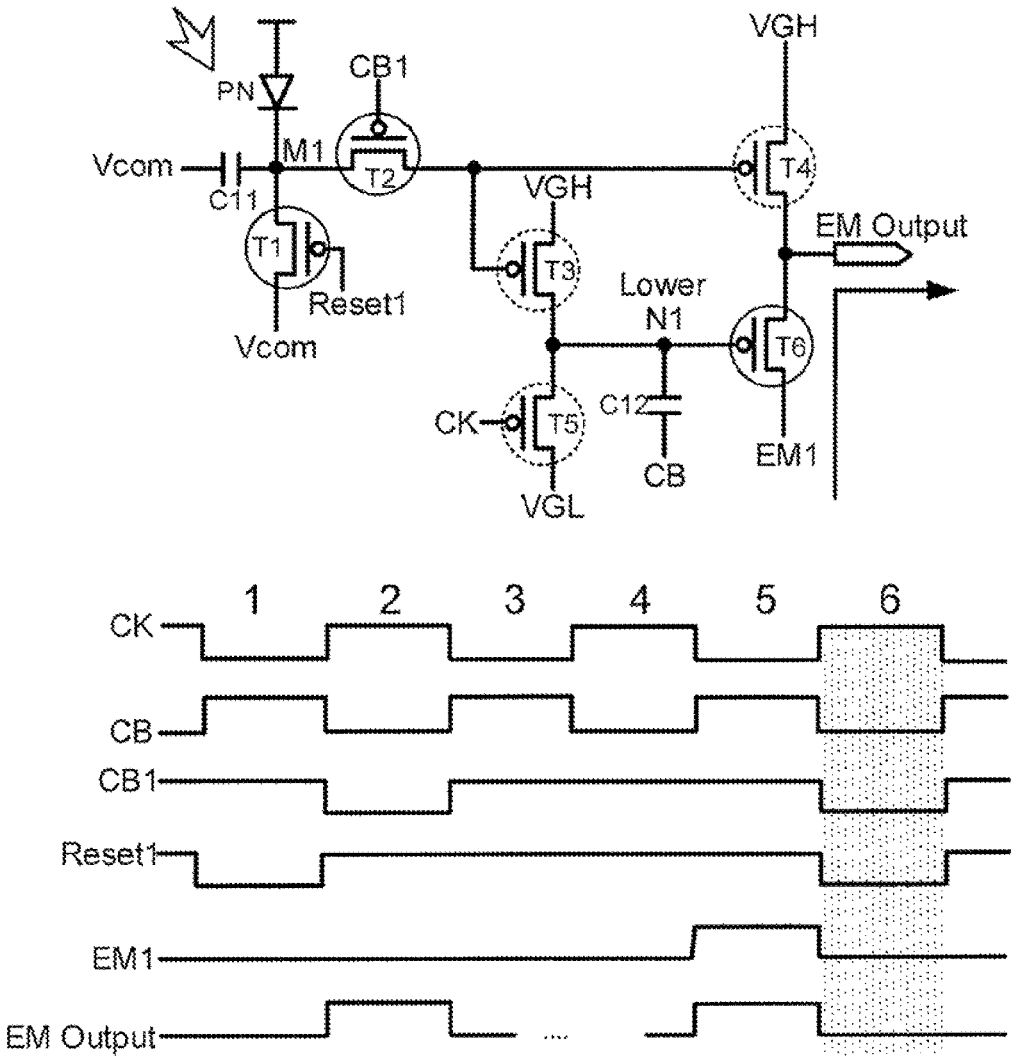
FIG. 6F is the emission-control circuit operated at a sixth time period set in the operational timing waveform in some embodiments.

In some embodiments, an emission-control circuit is provided for generating an updated EM signal to prevent OLED life span loss due to light emitting at high intensity for an extended period. FIG. 5A shows an emission-control circuit in some embodiments. FIG. 5B shows an operational timing waveform for operating the emission-control circuit of FIG. 5A. As shown in FIG. 5A, the emission-control circuit in the embodiment includes six TFTs and two storage capacitors. All six TFTs are P-type transistors, the same as the other TFTs implemented in the pixel driving circuit of FIG. 3. Moreover, this emission-control circuit is configured to share some control signal lines used for operating the pixel driving circuit of FIG. 3. Though not explicitly shown, some of those control signal lines belong to gate-on-array (GOA) peripheral circuits formed during a same TFT back panel process using exactly the same operational timing waveform.

Referring to FIG. 5A, the emission-control circuit includes a light sensor device PN, a first TFT T1, a second TFT T2, a third TFT T3, a fourth TFT T4, a fifth TFT T5, a sixth TFT T6, a first capacitor C11, and a second capacitor C12. In some embodiments, the light sensor device PN is a thin-film PIN junction photodiode having a P+ doping anode layer disposed in close proximity to the OLED light emitting layer. The thin-film PIN junction further includes an intrinsic layer having amorphous silicon (a+Si doping) and an N+ doping cathode layer. In an example, as shown in FIG. 2, the P+ doping semiconductor layer 21 of the PIN junction photodiode 20 is on a side of the passivation layer 17 distal to the anode layer 13 of the OLED. Optionally, a projection of the thin film PIN junction photodiode 20 overlaps with a projection of the anode layer 13 on the base substrate 12. The first capacitor C11 has a first terminal coupled to a system-provided voltage Vcom at a low potential level and a second terminal coupled to a first common node M1 coupled to the cathode of the PIN device, and source nodes of T1 and T2. The first TFT T1 has a gate controlled by a first control signal Reset1 and a drain node coupled to the Vcom at the low potential level. The second TFT T2 has a gate controlled by a second control signal CB1 and a drain node coupled to gates of T3 and T4. Both T3 and T4 have a source node coupled to a system-provided high voltage level $V_{GH}$. The third TFT T3 has a drain node coupled to a second common node N1 and the fourth TFT T4 has a drain node coupled to an output port called EM output. The second common node N1 is shared with the drain node of the third TFT T3, a drain node of the fifth TFT T5, a first terminal of the second capacitor C12, and a gate of the sixth TFT T6. The fourth TFT T4 has a source node coupled to the system high voltage level $V_{GH}$. The second capacitor C12 has a second terminal coupled to a third control signal CB. The fifth TFT T5 has a gate controlled by a fourth control signal CK and a source coupled to a system-provided low voltage level $V_{GL}$. The sixth TFT T6 has a source node coupled to a fifth control signal EM1 and a drain node coupled to the EM output for outputting an emission control signal. The timing wave forms with multiple sequential operation time periods for all control signals, first through fifth, and the emission control signal at EM output are illustrated in FIG. 5B.

In some embodiments, the emission-control circuit is integrated with the pixel driving circuit (e.g., a pixel compensation circuit) configured to operate using several control signals from driving signal lines in common Gate-on-Array (GOA) peripheral circuits. In an example, the EM output of the emission-control circuit of FIG. 5 is subsequently used as an input for providing the EM signal to the pixel driving circuit of FIG. 3. In another example, the third control signal CB, the fourth control signal CK, and the fifth control signal EM1 are the original CLK signals associated with the GOA circuits. Optionally, the third control signal CB and the fourth control signal CK are provided alternatively in high and low potential levels and out of phase to each other in all the sequential time periods. The fifth control signal EM1 is a signal for operating OLED module based on a system requirement for displaying a specific pixel of image at a specific time period. In the present disclosure, this fifth control signal EM1 becomes an input signal for the emission-control circuit of FIG. 5A for obtaining an EM output as an updated emission-control signal for the pixel driving circuit of FIG. 3. The first control signal Reset1 and the second control signal CB1 are generated separately from system peripheral circuits as two additional clock signals for operating the emission-control circuit. The timing waveform shown in the FIG. 5B illustrates each of the five control signals designated in six sequential time periods for operating the emission-control circuit to produce an EM output signal. Optionally, the EM output signal is used as an input to the pixel driving circuit (FIG. 3), and may be selectively switched from low to high potential level at least in one intermittent time period so that the OLED light emission can be temporarily turned off after a sustained high-intensity light emission period. By this control scheme, the emission-control circuit protects the OLED and prolongs its life span.

FIGS. 6A-6E show the emission-control circuit operated at respective six sequential time periods based on corresponding control signal timing waveform in some embodiments. As shown in these figures, the TFT marked by a solid line cycle represents an on-state transistor and the TFT marked by a dashed line cycle represents an Off-state transistor. In the first time period, the light sensor PN is reset. The Reset1 signal applied to the gate of the first TFT T1 is set to a low potential level to turn on the T1 so that a potential level at the first common node M1 is substantially the same as the voltage level Vcom at the drain node of T1. At the same time, the second control signal CB1 is set at a high potential level to turn off T2, and in turn, turn off T3 and T4. The node M1 is kept at the voltage level Vcom which makes the two terminals of the first capacitor C11 at the same potential (a discharge process). The third TFT T3 and the fourth TFT T4 are in Off-state. The fourth control signal CK is set to a low potential level to turn T5 on so that the second common node N1 is set to a low potential level the same as the system-provided $V_{GL}$ coupled to the source of T5. The low potential level at the node N1 is sufficient to turn T6 on so that the fifth control signal EM1 at the source of T6 is passed directly to its drain node as the EM output signal. In some embodiments, the EM output signal at this time period is able to drive the OLED light emitting for normal image display originally controlled by the EM1 signal. In general, this time period is a preparation phase in which the EM output signal is set to be the same as the original EM1 signal at a low potential level for keeping the OLED in light emitting state without triggering temperature compensation.

In a second time period, the OLED may have been at an on-state for a long time to emit light with high intensity. The light sensor PN detects the high intensity of OLED emitted light which induces a gradually increasing junction current across the reverse-bias PIN junction to cause a reduction of the potential level at the first common node M1. Because the first capacitor C11 has one terminal coupled to a voltage level Vcom, the reduction of the potential level at the other terminal, i.e., the first common node M1, happens gradually. In this time period, the first control signal Reset1 is switched to high to turn T1 off while the second control signal CB1 is switched to low to turn T2 on. This further pulls down the voltage level at both gates of T3 and T4. Gradually, the potential level eventually becomes low enough to turn the third TFT T3 and the fourth TFT T4 on. The on-state of T3 allows the system-provided high potential level $V_{GH}$ to pass to the second common node N1. The high potential level at the second common node N1 is able to charge the second capacitor C12 which has its opposite terminal provided with a low voltage level as the fourth control signal CK is set to high to turn T5 off to prevent any current leakage and keep the node N1 at the system-provided high potential level $V_{GH}$. Since the second common node N1 is connected to the gate of the sixth TFT T6, this high potential level at node N1 keeps T6 off. Thus, the On-state T4 allows a system-provided high potential level $V_{GH}$ to pass to its drain node outputted as an EM output signal. This EM output signal is a signal at a high potential level passed from the source of T4. This is inverted from the low potential level assigned to the EM1 signal originally designed for keeping the OLED at on-state for continuous image display. In other words, the operation of the emission-control circuit in this time period yields an intermittent time for temporarily turning off the OLE to prevent it from overheating due to high intensity light emission for a long time.

In a third time period, the first, second, and third control signals are all set to high, making T1, T2, T3, and T4 at off-state. Specifically, the first control signal Reset1 is maintained at a high level sufficient for turning T1 off. The second control signal CB1 is switched to a high level sufficient for turning T2 off and, in turn, turning T3 and T4 off. The fourth control signal CK is set at low to turn T5 on, making the second common node N1 at a low potential level, which may sufficiently turn the sixth TFT T6 on so that the fifth control signal EM1 (from the source of T6 to its drain) is outputted directly as the EM output signal at the same low voltage signal. In other words, after the previous intermittent off-time in the second time period, the emission-control circuit again produces an emission control signal to turn the OLED back on to emit light for normal image display.

In a fourth time period, the first and second control signals are kept the same as the third time period to keep all T1, T2, T3, and T4 at off-state. Specifically, the first control signal Reset1 is maintained at a high level sufficient for turning T1 off. The second control signal CB1 is maintained at a high level sufficient for turning off T2 and, in turn, turning T3 and T4 off. However, the fourth control signal CK is set at high to turn T5 off. Now the second common node N1 is at a floating state at a low potential defined in previous third time period. The third control signal CB is set at low at the other terminal of the second capacitor C12 opposing to the N1, which effectively pulls down voltage level of the node N1 to an even lower potential level than that in the third time period. In this time period, the second common node N1 is kept at sufficiently low potential level to turn T6 on to allow the fifth control signal EM1 to be directly outputted as the EM output signal. Again, the EM output signal retains the same low potential level of the EM1 signal in this time period to maintain the OLED light emitting status for normal image display.

In the fifth time period, the second control signal CB1 is at a high potential level sufficient for turning off T2. The third TFT T3 and the fourth TFT T4 are also kept at Off-state as in the previous fourth time period. No high voltage signal is leaked to the second common node N1 and the drain node of T4. The fourth control signal CK is set at a low level sufficient for turning on T5, and allow the system low voltage level VGL flowing through T5 to the second common node N1 to further turn the sixth TFT T6 on. The third control signal CB is set at a high level to charge the second capacitor C12 for holding the node N1 potential level. The On-state T6 allows the fifth control signal EM1 to pass to the drain node outputted as EM output. In this time period, the fifth control signal EM1 is switched from a low voltage level to a high voltage level. Accordingly, the EM output signal is the same high potential level as the EM1 signal to keep OLED light emission at an off state as required for normal image display at this time period.

In the sixth time period, both the first control signal Reset1 and the second control signal CB1 are reset to low to turn both T1 and T2 on at the same time. The first common node M is at the voltage level Vcom which is set as a level not low enough to turn T3 and T4 on. At the same time, the fourth control signal CK is set to high to keep T5 off so that the second common node N1 is at a floating state at a low potential defined in previous fifth time period. The third control signal CB is set to a low potential level at the other terminal of the second capacitor C12, pulling down the potential level of the node N1 to an even lower potential level than that in the fifth time period. This lower potential level effectively keeps the sixth TFT T6 on. Thus, the EM output signal is outputted substantially the same as the fifth control signal EM1 passed from the source node of T6, which is a control signal supposed to make the OLED at On-stage for emitting light.

In some embodiments, the driving method includes selectively switching the first control signal Reset1 from high to low at a proper time for resetting the light sensor PN. Optionally, as shown in the first time period, the first control signal Reset1 is timely switched to low at the gate of the first TFT T1 when the second control signal CB1 and the third control signal CB are at high voltage levels and the fourth control signal CK is at a low voltage level. This setting helps the emission-control circuit to be prepared for turning off the OLED. As the OLED has been continuously at an On-state for emitting light and the light sensor may have detected high-intensity of light for an extended period of time to cause a PN junction current to increase gradually, the emission-control circuit generates an EM output signal to drive the pixel driving circuit for initiating a temporary shutoff in a next intermittent time period. Optionally, as shown in the sixth time period, the first control signal Reset1 is timely switched to low at the gate of the first TFT T1 when the second control signal CB1 and the third control signal CB are at low voltage levels and the fourth control signal CK is at a high voltage level. This setting selectively allows the emission-control circuit to output an EM output signal to drive the pixel driving circuit for keeping the originally planned off-time of the OLED.

In another aspect, the present disclosure provides a display apparatus having a plurality of pixels for image display, each of which includes at least one OLED. In some embodiments, the OLED includes the emission-control circuit described herein configured to generate an emission control signal for selectively turning off the OLED in one or more intermittent time periods during image display based on the intensity of emitted light of the OLED detected by the light sensor. Optionally, the OLED further includes a base substrate, a thin film transistor on the base substrate, a first electrode layer on a side of the thin film transistor distal to the base substrate, an electroluminescence material layer on a side of the first electrode layer distal to the base substrate, and a second electrode layer on a side of the electroluminescence material layer distal to the first electrode layer. Optionally, the OLED further includes a pixel compensation circuit. Optionally, the first electrode layer is an anode layer, and the second electrode layer is a cathode layer.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An emission-control circuit for controlling light emission of an organic light emitting diode (OLED), comprising:

a light sensor configured to detect an intensity of emitted light of the OLED;

a first thin-film transistor (TFT);

a second TFT;

a third TFT;

a fourth TFT;

a fifth TFT;

a sixth TFT;

a first capacitor; and a second capacitor;

wherein the first capacitor has a first terminal configured to be provided with a voltage level Vcom and a second terminal coupled to a first common node shared with a cathode of the light sensor and source nodes of the first TFT and the second TFT;

the first TFT has a gate controlled by a first control signal and a drain node configured to be provided with the voltage level Vcom;

the second TFT has a gate controlled by a second control signal and a drain node coupled to gates of the third TFT and the fourth TFT;

the third TFT has a source node configured to be provided with a system high voltage level $V_{GH}$, and a drain node coupled to a second common node shared with a drain node of the fifth TFT and a first terminal of the second capacitor;

the fourth TFT has a source node configured to be provided with the system high voltage level $V_{GH}$;

the second capacitor has a second terminal configured to be provided with a third control signal;

the fifth TFT has a gate controlled by a fourth control signal and a source node configured to be provided with a system low voltage level $V_{GL}$; and the sixth TFT has a gate coupled to the second common node, a source node configured to be provided with a fifth control signal, and a drain node coupled to a drain node of the fourth TFT for outputting an emission control signal.

2. The emission-control circuit of claim 1, wherein the light sensor comprises a PN junction on a base substrate of the OLED.

3. The emission-control circuit of claim 2, wherein the PN junction is a PIN photodiode and configured to have an anode of a P+ doping semiconductor region at a system low voltage level, a cathode of a N+ doping semiconductor region coupled to the first common node, and an intrinsic region of amorphous silicon between the P+ doping semiconductor region and the N+ doping semiconductor region.

4. The emission-control circuit of claim 3, wherein the PIN photodiode is configured to detect the intensity of emitted light of the OLED for a period of time for generating a photo-current such that a voltage level at the first common node is reduced from the voltage level Vcom by a first amount to a reduced voltage level, the first amount being dependent on doping properties of the P+ doping semiconductor region and the N+ doping semiconductor region.

5. The emission-control circuit of claim 4, wherein the voltage level at the first common node is reduced to a level sufficiently low for turning on the fourth TFT, provided that the second TFT is turned on by the second control signal.

6. The emission-control circuit of claim 1, wherein the emission control signal is an input signal for a pixel driving circuit configured to compensate transistor threshold voltage shift of the OLED.

7. The emission-control circuit of claim 6, wherein the third control signal, the fourth control signal, and the fifth control signal are clock signals shared with the pixel driving circuit.

8. The emission-control circuit of claim 1, wherein the emission control signal is a high voltage level sufficient for turning off the OLED light emission in one or more intermittent time periods in a continuous time span during which the fifth control signal is kept at a low voltage level; and the emission control signal is the high voltage level sufficient for turning off the OLED light emission in a time period during which the fifth control signal is kept at a high voltage level.

9. The emission-control circuit of claim 1, wherein the first control signal is an independently generated clock signal for resetting the light sensor.

10. The emission-control circuit of claim 1, wherein the second control signal is an independent generated clock signal for switching on or off the second TFT.

11. The emission-control circuit of claim 1, wherein the first TFT, the second TFT, the third TFT, the fourth TFT, the fifth TFT, and the sixth TFT are all P-type transistors.

12. A display apparatus comprising a plurality of pixels for image display, each pixel comprising at least one organic light emitting diode (OLED);

wherein the at least one OLED comprises a base substrate, a thin film transistor on the base substrate, a first electrode layer on a side of the thin film transistor distal to the base substrate, an electroluminescence material layer on a side of the first electrode layer distal to the base substrate, and a second electrode layer on a side of the electroluminescence material layer distal to the first electrode layer; and the emission-control circuit of the claim 1 configured to generate an emission control signal for selectively turning off the OLED in one or more intermittent time periods during image display based on the intensity of emitted light of the OLED detected by the light sensor.

13. The display apparatus of claim 12, further comprising a pixel driving circuit configured to compensate transistor threshold voltage shift of the OLED, wherein the emission-control circuit is coupled with the pixel driving circuit.

14. The display apparatus of claim 13, wherein the pixel driving circuit comprises a P-type transistor with a gate node controlled by the emission control signal and a drain node connected with the OLED.

15. A driving method for controlling light emission of an organic light emitting diode (OLED) using an emission control circuit for controlling light emission of the OLED:

wherein the emission control circuit comprises a light sensor configured to detect an intensity of emitted light of the OLED; a first thin-film transistor (TFT); a second TFT; a third TFT; a fourth TFT; a fifth TFT; a sixth TFT; a first capacitor; and a second capacitor; wherein the first capacitor has a first terminal configured to be provided with a voltage level Vcom and a second terminal coupled to a first common node shared with a cathode of the light sensor and source nodes of the first TFT and the second TFT; the first TFT has a gate controlled by a first control signal and a drain node configured to be provided with the voltage level Vcom; the second TFT has a gate controlled by a second control signal and a drain node coupled to gates of the third TFT and the fourth TFT; the third TFT has a source node configured to be provided with a system high voltage level $V_{GH}$, and a drain node coupled to a second common node shared with a drain node of the fifth TFT and a first terminal of the second capacitor; the fourth TFT has a source node configured to be provided with the system high voltage level $V_{GH}$; the second capacitor has a second terminal configured to be provided with a third control signal; the fifth TFT has a gate controlled by a fourth control signal and a source node configured to be provided with a system low voltage level $V_{GL}$; and the sixth TFT has a gate coupled to the second common node, a source node configured to be provided with a fifth control signal, and a drain node coupled to a drain node of the fourth TFT for outputting an emission control signal;

the driving method comprising:

in a first time period, setting the first control signal at a low level sufficient for turning the first TFT on and keeping the first common node at the voltage level Vcom, setting the fourth control signal at a low level sufficient for turning the fifth TFT on to allow a system low voltage level $V_{GL}$ passing to the second common node for turning the sixth TFT on, and setting the second control signal at a high level sufficient for turning the second TFT off and, in turn, turning the third TFT and the fourth TFT off;

in a second time period, switching the first control signal to a high level sufficient for turning the first TFT off, setting the second control signal at a low level sufficient for turning the second TFT on, the light sensor is subject to a sufficiently high intensity of emitted light of the OLED to generate a photocurrent to pull down a voltage of the first common node from the voltage level Vcom to a sufficient low voltage level for turning the third TFT on to allow the system high voltage level $V_{GH}$ passing to the second common node for turning the sixth TFT off, setting the fourth control signal at a high level sufficient for turning the fifth TFT off; and turning the fourth TFT on by the sufficiently low voltage level at the first common node to allow the system high voltage level $V_{GH}$ passing to the drain node of the fourth TFT;

in a third time period, switching the second control signal to a high level for turning the second TFT off and, in turn, turning the third TFT and the fourth TFT off, setting the fourth control signal at a low level sufficient for turning the fifth TFT on and, in turn, reducing a voltage level at the second common node to a low voltage level sufficient for turning the sixth TFT on;

in a fourth time period, keeping the first TFT, the second TFT, the third TFT, the fourth TFT off, switching the fourth control signal to a high level sufficient for turning the fifth TFT off to keep the second common node in a floating state, switching the third control signal to a low level to pull down a voltage of the second common node to a sufficiently low level to keep the sixth TFT on;

in a fifth time period, keeping the first TFT, the second TFT, the third TFT, the fourth TFT off, switching the fourth control signal to a low level sufficient for turning the fifth TFT on to pull down a voltage of the second common node to the system low voltage level for turning the sixth TFT on; and in a sixth time period, turning the first TFT and the second TFT on to keep the first common node at the voltage level Vcom to keep the third TFT and the fourth TFT off, switching the fourth control signal to a high level sufficient for turning the fifth TFT off to keep the second common node in a floating state, and setting the third control signal to a low level to pull down a voltage of the second common node to a sufficiently low level to keep the sixth TFT on.

16. The driving method of claim 15, wherein in the second time period the sixth TFT is turned off, and the fourth TFT is turned on to pass the system high voltage level $V_{GH}$ from its source node to its drain node for outputting the emission control signal with a high voltage level for intermittently switching OLED light emission off within the second time period.

17. The driving method of claim 15, wherein in the third time period and the fourth time period, the fourth TFT is turned off and the sixth TFT is turned on so that the fifth control signal set at a low voltage level is passed from a source node of the sixth TFT to the drain node of the sixth TFT for outputting a low voltage level as the emission control signal to keep the OLED light emission on.

18. The driving method of claim 15, wherein in the fifth time period, the fourth TFT is turned off and the sixth TFT is turned on so that the fifth control signal set at a high voltage level is passed from a source node of the sixth TFT to the drain node of the six TFT for outputting a high voltage level as the emission control signal to turn the OLED light emission off.

19. The driving method of claim 15, wherein in the first time period, the first control signal is a reset signal selectively applied to the gate of the first TFT.

20. The driving method of claim 15, wherein in the sixth time period, the first control signal is a reset signal selectively applied to the gate of the first TFT at a low level sufficient for turning the first TFT on, and the second control signal is set at a low voltage level sufficient for turning the second TFT on.

* * * * *